US005088696A

United States Patent [19]

Desaar

[11] Patent Number: 5,088,696

[45] Date of Patent: Feb. 18, 1992

[54] MULTI-TUBE BLOWING LANCE

[75] Inventor: René Desaar, Grâce-Hollogne, Belgium

[73] Assignee: Recherches et Developpements Desaar, Belgium

[21] Appl. No.: 593,431

[22] Filed: Oct. 5, 1990

[30] Foreign Application Priority Data

Sep. 10, 1989 [BE] Belgium ..... 08901082

[51] Int. Cl.[5] ..... C21C 5/32

[52] U.S. Cl. ..... 266/225; 75/553; 75/558

[58] Field of Search ..... 266/225, 226; 75/553, 75/558

[56] References Cited

U.S. PATENT DOCUMENTS 4,852,860 8/1989 Griffing et al. ..... 266/225

*Primary Examiner*—Melvyn J. Andrews
*Attorney, Agent, or Firm*—Sughrue, Mion, Zinn, Macpeak & Seas

[57] ABSTRACT

A lance intended for injecting oxygen and/or an inert gas into liquid steel comprises a metal supply tube which opens into a distributor from which issue a plurality of injection tubes arranged parallel and concentrically with respect to the longitudinal axis of the lance, these injection tubes being embedded in a sheath of refractory material. Preferably, the distributor comprises two chambers which are separate from each other, the first chamber communicating with the supply tube for a first gas and with a plurality of first injection tubes, and the second chamber communicating with a second supply pipe for another gas and with a plurality of second injection tubes.

2 Claims, 5 Drawing Sheets

12
11
15
21
18

MULTI-TUBE BLOWING LANCE

FIELD OF THE INVENTION

This present invention relates to a lance intended for injecting oxygen and/or an inert gas into liquid steel.

BACKGROUND OF THE INVENTION

A previously proposed blowing lance is formed of a metal tube surrounded by a sheath of refractory material over at least part of its length. In a lance intended for blowing oxygen, the tube is made of copper; in a lance intended for blowing an inert gas, the tube is made of steel. At present there is no lance which can be used both for blowing oxygen and for blowing an inert gas, so that, in steel works, it is at present necessary to have available the two types of lance. The first type of lance in effect serves to heat up the steel in the ladle to bring the temperature of the liquid steel to the value strictly set for casting. A lance of the second type is used for homogenising the steel in the ladle. Furthermore, in general, the known lances only comprise a single tube.

BRIEF SUMMARY OF THE INVENTION

The subject of the present invention is a multi-tube lance, in particular a mixed multi-tube lance, that is to say, a lance which can be used equally well for blowing oxygen and for blowing an inert gas.

According to the present invention there is provided a blowing lance for injecting a gas into liquid steel, comprising a metal supply tube, fixing means at one end of said metal tube for connecting the latter to a gas supply source, a distributor into which said supply tube opens at its other end, a plurality of injection tubes arranged parallel to and concentrically with respect to the longitudinal axis of the lance and connected to and extending from said distributor, and a sheath of refractory material in which said injection tubes are embedded.

Preferably, the distributor comprises two chambers which are separate from each other: the first chamber communicates with the afore-mentioned supply tube and with a plurality of first injection tubes, and the second chamber communicates with a plurality of second injection tubes and with a second supply tube for another gas, the first and second injection tubes being embedded in the sheath of refractory material. The same lance can thus be used either for injecting oxygen, for instance, by means of the first injection tubes, or for injecting an inert gas, for instance, by means of the second injection tubes.

BRIEF DESCRIPTION OF THE SEVERAL VIEWS OF THE DRAWINGS

The invention will not be described in greater detail with reference to the accompanying drawings, which illustrate diagrammatically and by way of example two embodiments thereof, and in which:

Referring now to FIGS. 1 through 5 of the drawings, there is shown a lance comprising a metal supply tube 11 which is preferably made of stainless steel or of copper and which is provided at its upper end with a fixing device 12 for connection to the outlet 20 of an oxygen supply source (not shown). The fixing device 12 engages an outer thread 13 on the supply tube 11 and includes a tightening spring 14.

Figure 1:
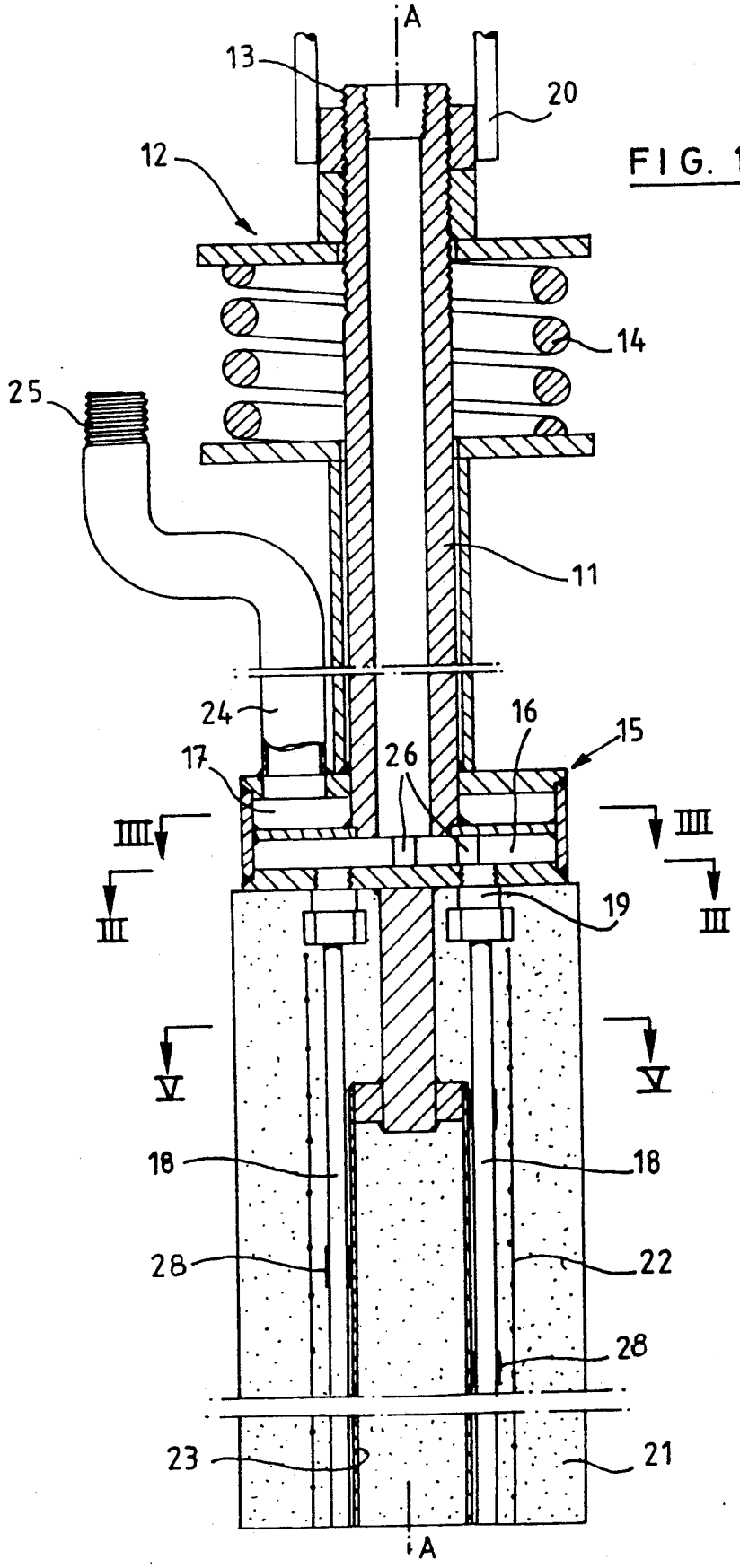
FIG. 1 is a view in axial section of a mixed lance according to the invention.
Figure 2:
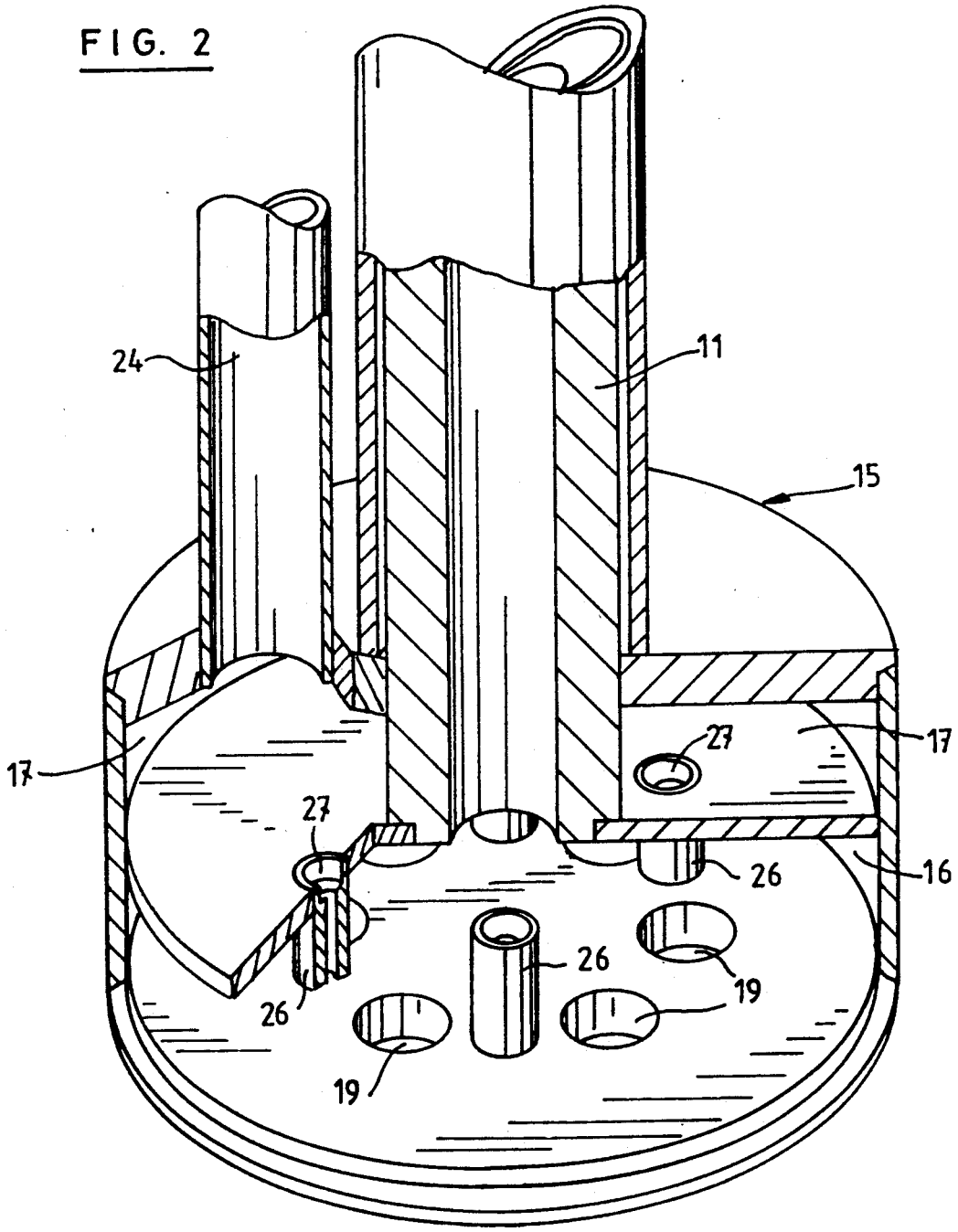
FIG. 2 is a perspective cut-away view of part of the lance shown in FIG. 1.
Figure 3:
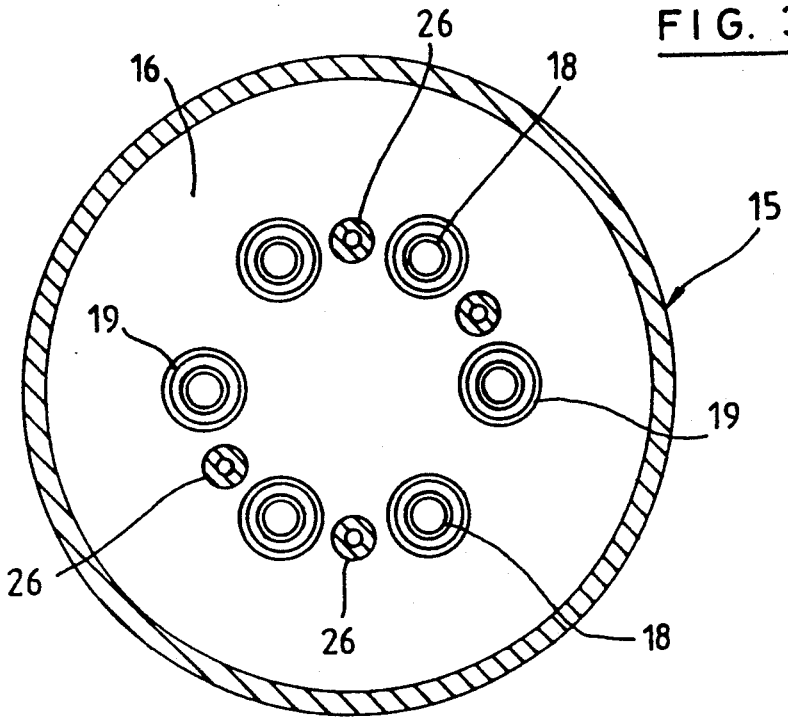
FIG. 3 is a transverse section along the line III—III of FIG. 1.

At its lower end, the supply tube 11 is fixed to a substantially cylindrical distributor 15 defining two chambers 16 and 17, the distributor 15 being shown in perspective in FIG. 2 from which it will be seen that the two chambers are separated by an annular partition 9. The supply tube 11 opens into the chamber 16 which is the lower of the two chambers. The chamber 16 communicates with a plurality of injection tubes 18 fixed by means of connectors 19 (FIGS. 1, 2 and 3) to the base 15' of the distributor 15. The injection tubes 18 are arranged parallel to each other about the longitudinal axis A—A of the lance FIG. 1.

The injection tubes 18 are embedded in a sheath 21 of refractory material. In the latter there is preferably, but not necessarily, embedded a metal lattice 22 which surrounds all the injection tubes 18. This lattice serves as a reinforcing member while ensuring homogenous continuity of the refractory substance which passes through the lattice. The injection tubes 18 are held by tubular guides 28 fixed to the wall of a central tube 23.

Figure 4:
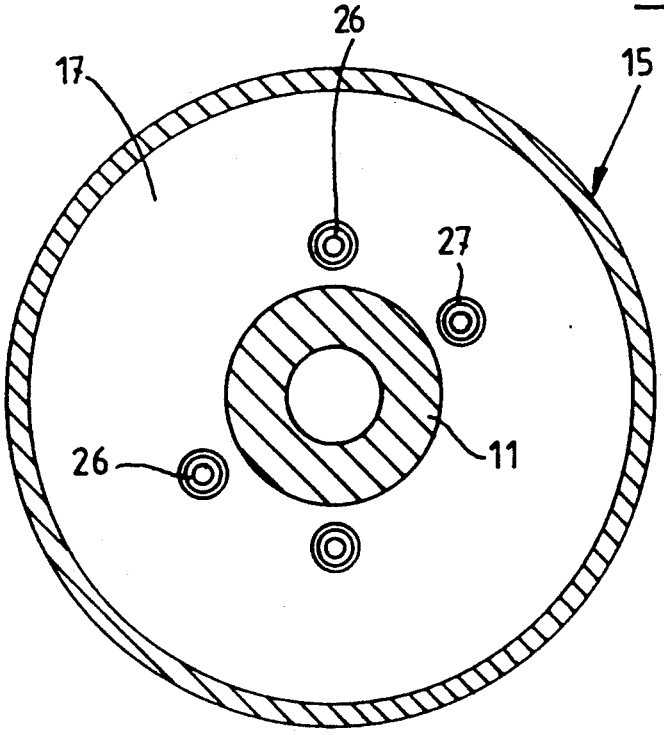
FIG. 4 is a transverse section along the line IV—IV of FIG. 1.
Figure 5:
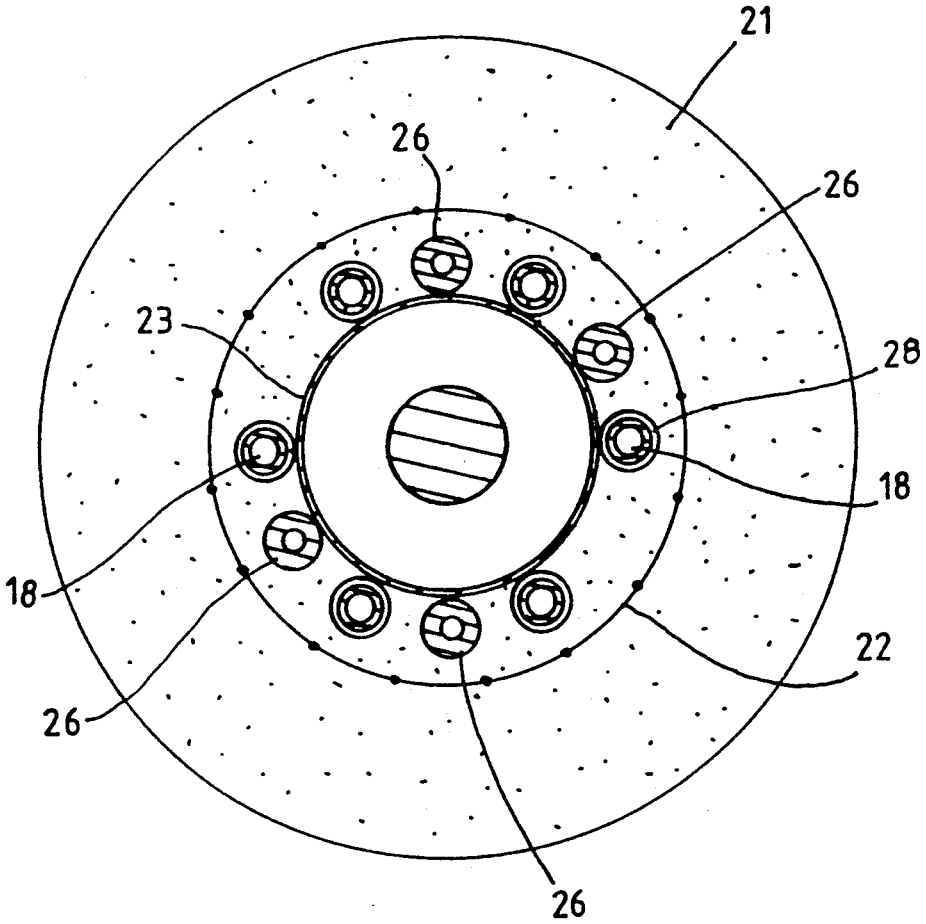
FIG. 5 is a transverse section along the line V—V of FIG. 1.

The second chamber 17 of the distributor 15, communicates with a supply pipe 24 provided with means 25, in this case a screw thread, for connection to an inert gas supply source (not shown), for instance a source of argon. The chamber 17 likewise communicates (see FIGS. 2 and 4) with a plurality of second injection tubes 26 fixed at their upper ends in the annular partition 9 by means of connectors 27. Just like the injection tubes 18, the tubes 26 are embedded in the refractory sheath 21, and are arranged concentrically to the longitudinal axis of the lance (see FIG. 5). The injection tubes 18 and 26 open into the lower face of the sheath 21. The parts of the distributor 15 which are in contact with the oxygen are preferably made of copper or stainless steel. The injection tubes 18 are for instance 10/8 mm copper tubes; the injection tubes 26 are for instance 12/4 mm steel tubes.

Due to its construction, the lance as described above may be used both for injecting oxygen in order to bring the liquid steel contained in a foundry ladle back to the desired temperature and for blowing an inert gas in order to homogenise the liquid steel. Furthermore, the arrangement of a plurality of injection tubes communicating with each of the chambers 16 and 17 (or possibly with only one of the chambers) ensures a better dynamic effect within the bath of liquid steel.

Figure 6:
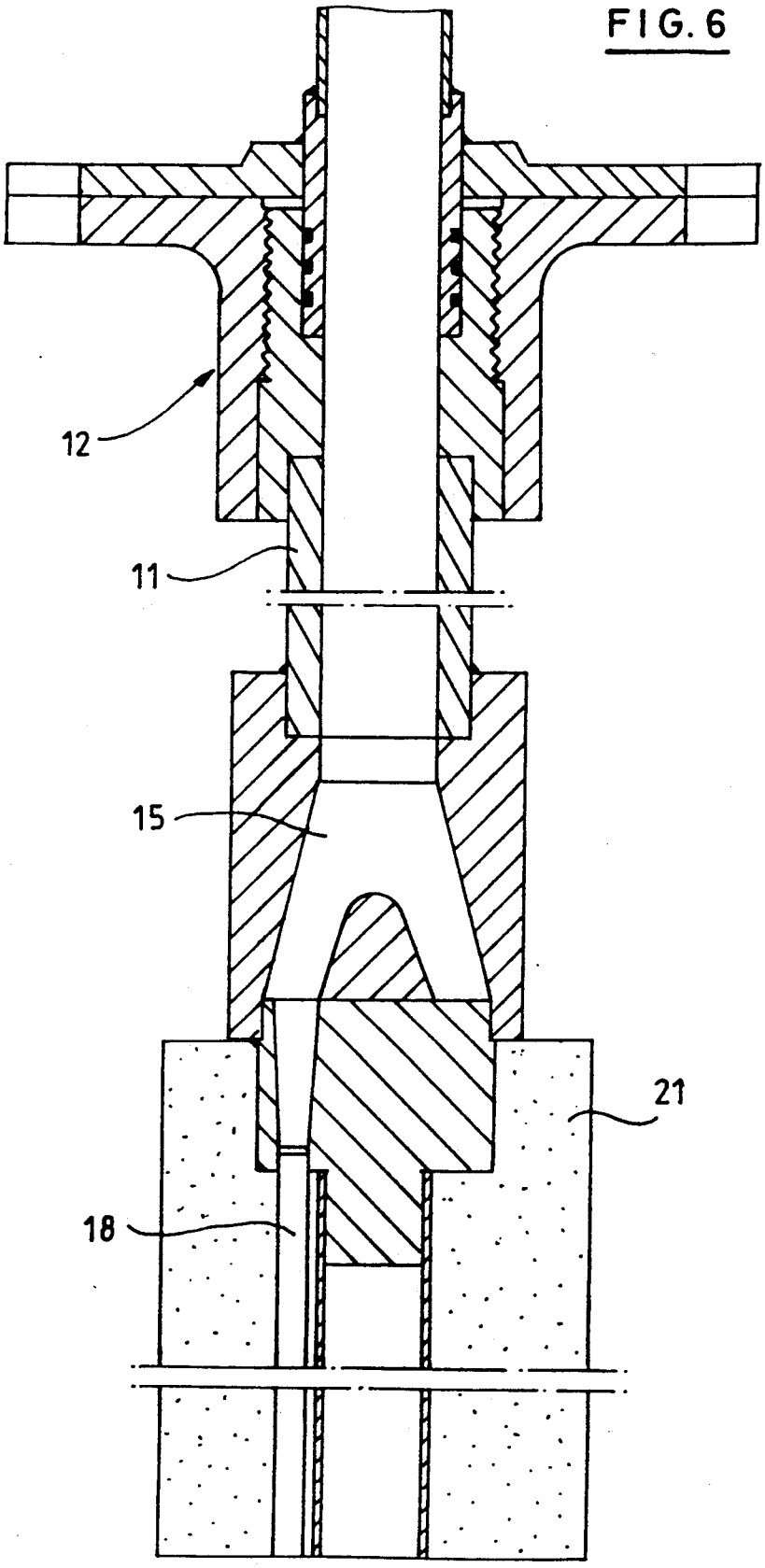
FIG. 6 is a view in axial section of part of another and simplified lance according to the invention.

FIG. 6 shows an alternative embodiment in the form of a simple lance, that is to say, a lance for blowing a single gas. A supply tube 11 is provided at its upper end with a fixing device 12 and opens at its lower end into a distributor 15 with a single chamber. A plurality of injection tubes 18 embedded in a sheath 21 of refractory material issue from this distributor 15. The injection tubes 18, which may be of any number, open in the lower face of the sheath 21. The arrangement of a plurality of injection tubes ensures an excellent dynamic effect within the bath of liquid steel. The material of which the injection tubes are made and their dimensions are adapted to the nature of the gas which the lance is intended to convey.

The embodiments of the invention described above are examples given by way of example, and the invention is in no way limited to these examples. Any modification, any variant and any equivalent construction must be considered as being included within the scope of the invention.

What is claimed is:

1. A blowing lance for injecting a gas into liquid steel, comprising a first metal supply tube, fixing means at one end of said metal tube for connecting the latter to a first gas supply source, a distributor into which said supply tube opens at its other end, a plurality of first injection tubes arranged parallel to and concentrically with respect to the longitudinal axis of the lance and connected to and extending from said distributor, and a sheath of refractory material in which said first injection tubes are embedded; and further comprising a second supply tube and a plurality of second injection tubes, and wherein said distributor defines first and second chambers which are separate from each other, said first chamber communicating with said first supply tube and with said plurality of first injection tubes, said second chamber communicating with said second supply tube and with said plurality of second injection tubes, said second supply tube being provided with a fixing device for connection to a second gas supply source, and said second injection tubes also being embedded in the sheath of refractory material.

2. The lance according to claim 2, wherein the sheath comprises a metal lattice embedded in the refractory material, said lattice extending around said first and second injection tubes.

* * * * *